US008424609B2

(12) United States Patent
Duphorne et al.

(10) Patent No.: US 8,424,609 B2
(45) Date of Patent: Apr. 23, 2013

(54) APPARATUS AND METHOD FOR CONTROLLING FLUID FLOW BETWEEN FORMATIONS AND WELLBORES

(75) Inventors: Darin H. Duphorne, Houston, TX (US); Eddie G. Bowen, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 407 days.

(21) Appl. No.: 12/725,273

(22) Filed: Mar. 16, 2010

(65) Prior Publication Data

US 2011/0226481 A1 Sep. 22, 2011

(51) Int. Cl.
*E03B 3/18* (2006.01)
*E03B 3/24* (2006.01)
*E03B 3/26* (2006.01)

(52) U.S. Cl.
USPC ..... 166/373; 166/227; 166/236

(58) Field of Classification Search ..... 166/373, 166/227, 236; 137/42
See application file for complete search history.

(56) References Cited

U.S. PATENT DOCUMENTS

| | | | | |
|---|---|---|---|---|
| 80,875 | A * | 8/1868 | Platt | 166/227 |
| 85,428 | A * | 12/1868 | Burditt et al. | 166/228 |
| 1,342,813 | A * | 6/1920 | Huston | 166/158 |
| 3,025,914 | A * | 3/1962 | Fether | 166/235 |
| 3,133,595 | A * | 5/1964 | Loughney et al. | 166/228 |
| 4,125,129 | A * | 11/1978 | Baumann | 137/625.3 |
| 6,978,840 | B2 | 12/2005 | Henderson | |
| 7,055,598 | B2 | 6/2006 | Ross et al. | |
| 7,578,343 | B2 | 8/2009 | Augustine | |
| 2007/0131434 | A1 | 6/2007 | MacDougall et al. | |
| 2009/0133874 | A1 | 5/2009 | Dale et al. | |
| 2011/0079396 | A1 * | 4/2011 | Russell et al. | 166/369 |

FOREIGN PATENT DOCUMENTS

WO WO2007/078375 * 7/2007

* cited by examiner

*Primary Examiner* — Cathleen Hutchins
(74) *Attorney, Agent, or Firm* — Cantor Colburn LLP

(57) ABSTRACT

In one aspect, a passive flow control device for controlling flow of a fluid is provided, which device in one configuration include a longitudinal member configured to receive fluid radially along a selected length of the longitudinal member, the longitudinal member including flow restrictions configured to cause a pressure drop across the radial direction of the longitudinal member. In another aspect, a method of completing a wellbore is provided, which method in one embodiment may include providing a flow control device that includes a tubular with a first set of fluid flow passages and at least one member with a second set of fluid passages placed outside the tubular, wherein the first and second set of passages are offset along a longitudinal direction and the member is configured to receive a fluid along the radial direction; placing the flow control device at a selected location a wellbore; and allowing a fluid flow between the formation and the flow control device.

24 Claims, 5 Drawing Sheets

APPARATUS AND METHOD FOR CONTROLLING FLUID FLOW BETWEEN FORMATIONS AND WELLBORES

BACKGROUND OF THE DISCLOSURE

1. Field of the Disclosure

The disclosure relates generally to apparatus and methods for control of fluid flow from subterranean formations into a production string in a wellbore.

2. Description of the Related Art

Hydrocarbons such as oil and gas are recovered from a subterranean formation using a well or wellbore drilled into a formation. In some cases the wellbore is completed by placing a casing along the wellbore length and perforating the casing adjacent each production zone (hydrocarbon bearing zone) to extract fluids (such as oil and gas) from such a production zone. In other cases, the wellbore may be open hole, and in a particular case may be used for injection of steam or other substances into a geological formation. One or more inflow control devices are placed in the wellbore to control the flow of fluids into the wellbore. These flow control devices and production zones are generally separated from each other by installing a packer between them. Fluid from each production zone entering the wellbore is drawn into a tubular that runs to the surface. It is desirable to have a substantially even flow of fluid along the production zone. Uneven drainage may result in undesirable conditions such as invasion of a gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil.

Horizontal wellbores are often drilled into a production zone to extract fluid therefrom. Several inflow control devices are placed spaced apart along such a wellbore to drain formation fluid. Formation fluid often contains a layer of oil, a layer of water below the oil and a layer of gas above the oil. A horizontal wellbore is typically placed above the water layer. The boundary layers of oil, water and gas may not be even along the entire length of the horizontal wellbore. Also, certain properties of the formation, such as porosity and permeability, may not be the same along the horizontal wellbore length. Therefore, fluid between the formation and the wellbore may not flow evenly through the inflow control devices. For production wellbores, it is desirable to have a relatively even flow of the production fluid into the wellbore. To produce optimal flow of hydrocarbons from a wellbore, production zones may utilize flow control devices with differing flow characteristics. Active flow control devices have been used to control the fluid from the formation into the wellbores. Such devices are relatively expensive and include moving parts, which require maintenance and may not be very reliable over the life of the wellbore. Passive flow control, which typically do not have moving parts, are used in the wellbore to control the flow if the fluids into the wellbore. Such devices are configured to flow the fluid axially along the device. The axial inflow can limit the flow of the fluid due to the limited surface area for axial inflow passages. Also, such passive devices are serially placed relative to sand screens, which are used to inhibit flow of solid particles into the wellbore. Such serial combination requires long combined devices.

The present disclosure provides apparatus and method for controlling flow of fluid between a wellbore and a formation that addresses some of the above-noted deficiencies of the inflow control devices.

SUMMARY

In one aspect a passive flow control device for controlling flow of a fluid is provided, which device in one configuration include a longitudinal member configured to receive fluid radially along a selected length of the longitudinal member, the longitudinal member including flow restrictions configured to cause a pressure drop across the radial direction of the longitudinal member.

In another aspect, a method of completing a wellbore is provided, which method in one embodiment may include providing a flow control device that includes a tubular with a first set of fluid flow passages and at least one member with a second set of fluid passages placed outside the tubular, wherein the first and second set of passages are offset along a longitudinal direction and the member is configured to receive a fluid along the radial direction; placing the flow control device at a selected location a wellbore; and allowing a fluid flow between the formation and the flow control device.

Examples of some features of the disclosure have been summarized rather broadly in order that detailed description thereof that follows may be better understood, and in order that some of the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings, in which like reference characters designate like or similar elements throughout the several figures of the drawing, and wherein.

DETAILED DESCRIPTION OF THE DISCLOSURE

Figure 1:
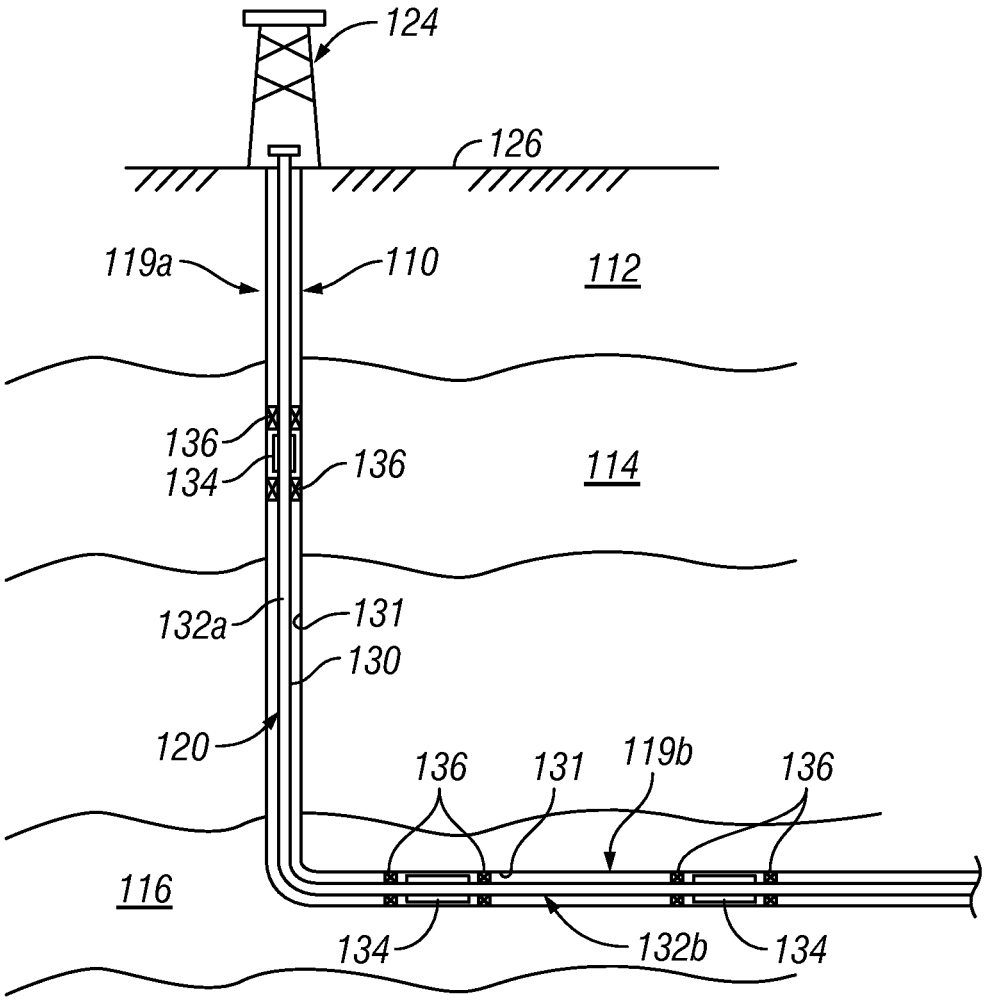
FIG. 1 is a schematic elevation view of an exemplary multi-zone wellbore that has a production string installed therein, which production string includes a number of flow control devices made according to one embodiment of the disclosure and placed at selected locations along the length of the production string.

The present disclosure relates to devices and methods for controlling production of hydrocarbons in wellbores. The present disclosure is susceptible to embodiments of different forms. There are shown in the drawings, and herein will be described, specific embodiments of the present disclosure with the understanding that the present disclosure is to be considered an exemplification of the principles of the devices and methods described herein and is not intended to limit the disclosure to embodiments illustrated and described herein.

FIG. 1 is a schematic diagram showing an exemplary wellbore 110 drilled through the earth 112 and into a pair of production zones 114, 116 from which hydrocarbon production is desired. The wellbore 110 has vertical section 119*a* and a deviated or substantially horizontal leg 119*b*. The wellbore 110 has disposed therein a production assembly 120 that extends downwardly from a wellhead 124 at the surface 126. The production assembly 120 defines an internal axial flow bore along its length. An annulus 130 is defined between the production assembly 120 and a wellbore inner surface 131. The production assembly 120 is shown to have a vertical portion 132*a* and a horizontal portion 132*b* that extends along the leg 119*b* of the wellbore 110. At selected locations along the production assembly 120 are flow control devices 134 made according to embodiments discussed herein. Optionally, flow control devices 134 may be isolated from each other within the wellbore 110 by a pair of packer devices 136.

The wellbore 110 is shown as an uncased borehole that is directly open to the formations 114, 116. Production fluids flow directly or indirectly from the formations 114, 116 into the annulus 130 defined between the production assembly 120 and a wall 131 of the wellbore 110 or casing (not shown). The flow control devices 134 govern one or more aspects of fluid flow into the production assembly 120. As discussed herein, the flow control devices 134 may also be referred to as production devices, inflow control devices (ICDs) or fluid control devices. In accordance with the present disclosure, the flow control devices 134 may have a number of alternative constructions that provide controlled fluid flow therethrough.

Each flow control device 134 may be used to govern one or more aspects of flow of one or more fluids from the production zones 114 and 116 into the production string 120. As used herein, the term "fluid" or "fluids" includes liquids, gases, hydrocarbons, multi-phase fluids, mixtures of two of more fluids, water, steam, and other fluids injected from the surface, such as water. Additionally, references to water should be construed to also include water-based fluids; e.g., brine or salt water. It should be noted that the wellbore 110 may be a case hole, wherein a casing (not shown) is placed between the production string 120 and the borehole wall 131. In a cased hole, the annulus between the wellbore wall 131 and the production string 120 is typically packed with cement and perforations formed in the casing and the formation allow the flow of the fluid from the formation into the casing.

Subsurface formations may have varying zones of permeability or porosity or may contain fluids having a variety of flow characteristics along its production intervals or between production zones. Prior flow control devices have been employed across such intervals or zones to equalize or balance or otherwise control the inflow across the intervals or zones to achieve a desired production from each such interval or zone. Such prior devices have been discrete devices spaced apart at desired locations. Increasing the number of flow control devices can improve the distribution across an interval. However, while embodiments of the present disclosure may likewise be deployed at discrete locations, other embodiments may provide continuously variable flow distribution along a length of the production string 120 in which such flow control devices are deployed.

Subsurface formations often contain water or brine along with oil and gas. Water may be present below an oil-bearing zone and gas may be present above such a zone. Once the wellbore has been in production for a period of time, water may flow into some of the flow control devices 134. The amount and timing of water inflow can vary along the length of the production zone. It is desirable to have flow control devices that will restrict the flow of fluids based on the amount of water or gas in the production fluid. By restricting the flow of water and/or gas, the flow control device enables more oil to be produced over the life of the production zone.

Figure 2:
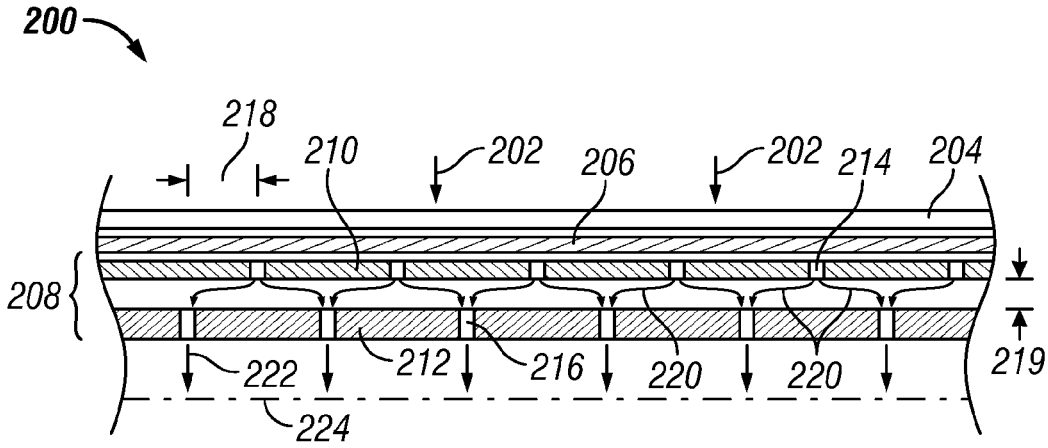
FIG. 2 shows a sectional side view of a portion of a flow control device made according to one embodiment the disclosure.

FIG. 2 shows a sectional side view of a portion of a flow control device 200 made according to one embodiment the disclosure. This illustration shows the profile of sections of an upper half of a cylindrical flow control device 200 and tubular or base pipe 212 having a number of flow restrictions or flow passages 216 along its longitudinal axis 224. The flow control device 200 is configured to receive the fluid 202 primarily in the radial direction. For the purposes of this disclosure, the radial direction or radially is a direction that is at an angle to the longitudinal axis or direction of a device, such as axis 224. Further, the term axial means a direction generally along the central axis of a longitudinal member or wellbore or along a line generally parallel to such central axis. Still further, the term "planar" means a direction, having circumferential and/or axial components along and between offset members or inflow layers 210, described further below, and any tubulars therearound or thereunder.

The flow control device 200 may include an offset member (also referred to as a longitudinal member, or "inflow layer") 210 placed around the tubular member 202, a screen (also referred to as sand screen) or another filter element 206 placed outside or around the offset members 210 and a shroud 204 placed outside or around the screen 206. In the configuration shown in FIG. 2, the combination of the tubular member 212 and the offset members 210 form an inflow control device 208 that controls the planar and radial flow paths of the fluid 202 in a generally radial direction into and through the flow control device 200.

In a simple embodiment, the inflow control device 208 includes a first layer 210 formed by the offset member 210 and a second layer formed by the tubular 212. The first layer 210 includes flow passages (also referred to as flow restrictions or holes) 214 that may act as orifices to create an orifice pressure drop function, and may be offset from the flow passages 216 in the tubular 212 to create a tortuosity pressure drop function and a frictional pressure drop function. The first layer receives the fluid along its length along a radial direction or radially. The flow passages or holes 214 and 216 are offset by a distance (or axial distance "x") 218 and are separated radially by distance (radial distance "h") 219 configured to create a tortuous flow path 220. In addition to the pressure drop resulting from the orifice restrictions in the layers, the tortuosity created by the offset openings causes a directional component of the fluid flow to change from radial to planar and/or axial and then again to predominately radial flow, and the amount of offset spacing between the openings provides a desired surface area contact to include a frictional flow path to include a frictional pressure drop component to the overall pressure drop across the device. The directional change may also create turbulence or other dynamic flow resistance functions as a contribution to the overall pressure drop across the device. The tortuous flow path 220 may also create turbulence and/or flow resistance as the fluid 202 flows radially from the formation to the tubular 212, as shown by arrows 220. The offset and the radial separation defines, at least in part the flow resistance, which defines the pressure drop across the portion 208. The offset and the radial distance may be selected to define the pressure drop based on one or more characteristics of the fluid, such as the amount of gas and/or water in the fluid.

Still referring to FIG. 2, the shroud 204 is a protection member configured to protect inner portions of the flow control device 200 from large particulates, such as rock fragments, which may damage a component when flowing at a high velocity. The shroud 204 may include flow ports (not shown) that allow the flow of the fluid 202 and restrict flow of large particulates into the flow control device 200. The screen 206 may be a filter member with flow paths or holes that remove sand or finer particles from fluid as it flows into the offset member 210. The flow path 220 then continues through axially and/or circumferentially offset holes 214 and 216 as shown by arrows 222. The distance 218 of the offset may be configured or designed to provide a tortuous path and/or fluid flow friction resulting in a pressure drop across the openings in the offset flow path members. As discussed herein, a tortuous or frictional flow path may create turbulences that restricts the flow area when the fluid includes water or gas. Such flow paths reduce the flow rate of the fluid by decreasing the kinetic energy (overall flow velocity) of the fluid.

The inflow control devices discussed herein may be configured to provide pressure drop behavior that may vary for fluids of different viscosities and/or densities. For example, the viscosity of pure water is 1 cP and the viscosity of the majority of oils present in subsurface formations is between 10 cP-200 cP. In an aspect, the total pressure drop across the inflow control device is generally the sum of the pressure drops across all the flow passages in the inflow control device. The flow path for the devices herein may be configured to provide higher pressure drop for water or gas and a low pressure drop for crude oil. For such a device, the pressure drop increases sharply as the fluid viscosity decreases below the oil viscosity. Certain examples of inflow flow control devices with offset flow paths along axial directions to create desired pressure drops for selected fluids are described in U.S. patent application Ser. No. 12/630,476, filed on Dec. 3, 2009, assigned to the assignee of this application, which is incorporated herein by reference in its entirety.

Still referring to FIG. 2, in one aspect the flow passages 214 and 216 have a relationship and dimensional characteristics that produce a selected pressure drop and, thereby, control the flow of selected fluids into the tubular. For example, the passages 214 and 216 may be circular and have a selected diameter configured to produce the desired turbulence and pressure drop to enable flow of a selected fluid in the wellbore tubular. In addition, the offset distance 218 may be configured to produce flow resistance and the desired turbulence and thus the pressure drop. In other embodiments, the passages may be of different geometries, such as rectangles or polygons. In addition there may be a radial or circumferential offset in addition to the axial offset. The circumferential offset may occur where holes in the offset flow path members are located in the same axial position, but are rotationally or circumferentially offset relative to one another at the axial location. Further, the radial spacing between layers may also be configured to produce volumes or cavities between passages to enhance control over the fluid flow. In one aspect, the offset members may include flow passages that are offset in an axial and circumferential direction to provide a tortuous path to provide a selected pressure drop profile. In aspects, the number of layers and configuration of passages may vary and various combinations of flow passage and offsets may be chosen to produce a desired flow regime through the flow control device. In the configuration of FIG. 2, the inflow control device 208 is integrated into or positioned within the sand screen 206, which enables an increase in the overall length compared to flow control devices where the inflow control device is coupled to the screen axially and the fluid flows axially from the sand screen into an adjacent inflow control device. Additionally, the inflow control device 208 is passive, i.e., it does not include active control elements, such as materials that change shapes based on fluids or downhole conditions. In an alternative embodiment, the inflow control device 208 may also include one or more shape-changing materials to provide a certain pressure drop. Also, the inflow control device 208 may be configured to allow flow along a portion of a wall of the inflow control device, for example along a top section of the offset member. In an aspect, the portion may be a rectangular section of the layer that forms a tubular member, wherein the section includes passages that are offset from a set of passages in the adjacent offset member.

Figure 3:
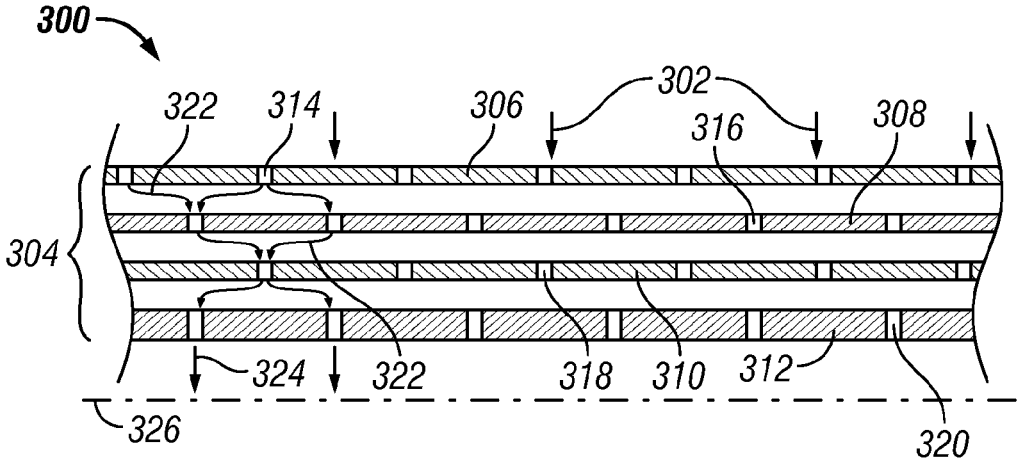
FIG. 3 shows a sectional side view of a portion of a flow control device made according to another embodiment of the disclosure.

Referring now to FIG. 3, there is shown a sectional side view of a portion of a flow control device 300 made according to one embodiment the disclosure. As depicted, the flow control device 300 is configured to control formation fluid flow 302 into the wellbore tubular 312. In one aspect, the flow control device 300 includes a set of radial flow members 304. The exemplary set of radial flow members (or inflow control device) 304 is shown to include three layers of offset members, a first layer 306, second layer 308, third layer 310 around a tubular 312. Each of the layers may be composed of a suitable durable and strong material, such as a metallic material or alloy, a composite material or a combination thereof. Each of the offset radial flow members 304 includes fluid passages 314, 316, 318 and 320 that are axially offset from one another relative to a tubular axis 326. The offsets may also be circumferential and/or radial. As previously discussed, the offsets is configured to provide a tortuous flow path 322 for a fluid as it flows between the layers into the tubular 312, shown by arrows 324.

Still referring to FIG. 3, the offset radial flow members 304 may produce a radial pressure drop between each of the layers, wherein the total pressure drop across the passages 314, 316, 318 and 320 results in enhanced control of fluid flow into the tubular 312. In addition, the flow restrictions may be located across substantially the entire portion of the tubular 312 and device 300, thereby enabling a balanced fluid flow into the tubular. The radial inflow configuration provides a larger inflow surface area to improve flow balance. Moreover, the flow control device 300 and offset radial flow members 304 may be configured to distribute fluid flow across the completion by gradually decreasing fluid inflow closer to the surface.

Figure 4A:
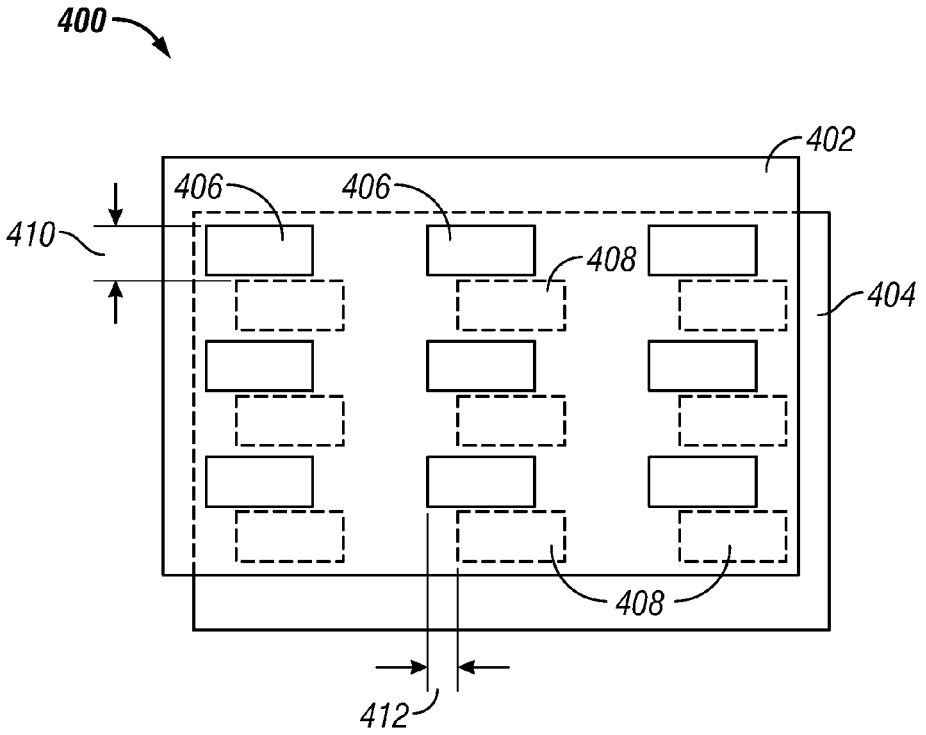
FIGS. 4A, 4B and 4C show top views of various exemplary flow passages that may be used in offset members.
Figure 4B:
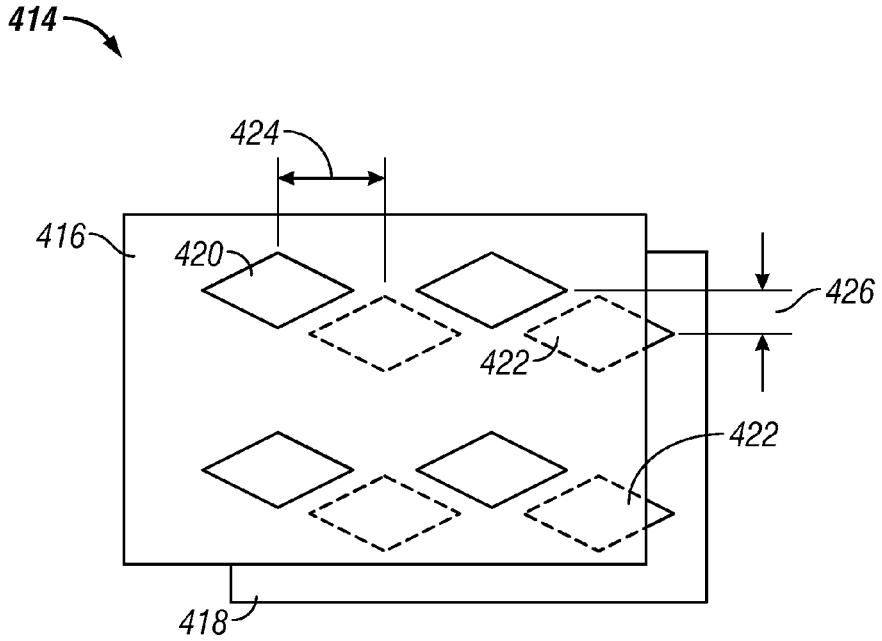
Figure 4C:
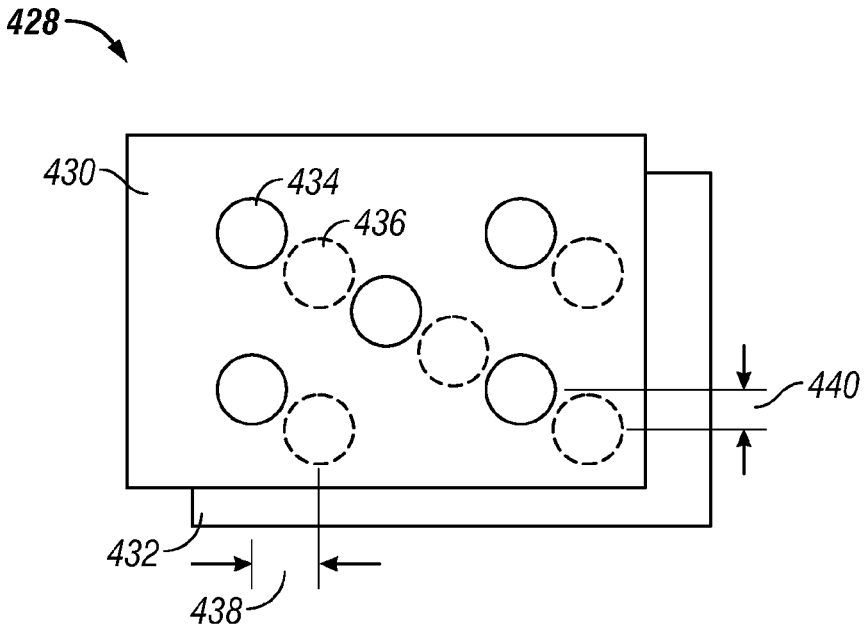

FIGS. 4A, 4B and 4C show top views of various embodiments of portions of offset radial flow members. The figures illustrate "flattened" tubular members, wherein each cylindrical member has been cut axially along a surface and flattened into a rectangular sheet. The figures show a detailed portion of each member or sheet to illustrate the relationships of flow holes in each member or layer. FIG. 4A is an embodiment of offset radial flow members 400, including a first layer 402 and second layer 404. The layers 402 and 404 include rectangular flow passages 406 and 408, respectively, where the passages are offset to cause turbulent fluid flow between the layers. The passages 406 and 408 are offset in two generally perpendicular directions, as illustrated by elements 410 and 412. In aspects, the inner layer (404) may also be a base pipe or tubular (as shown in FIG. 2).

FIG. 4B is an embodiment of offset radial flow members 414 that includes a first layer 416 and second layer 418. The layers 416 and 418 include diamond-shaped flow passages 420 and 422, respectively, where the passages are offset to cause turbulent fluid flow between the layers. The passages 420 and 422 are offset in two directions, as illustrated by elements 424 and 426. FIG. 4C is an embodiment of offset radial flow members 428 that includes a first layer 430 and second layer 432. The layers 430 and 432 include circular flow passages 434 and 436, respectively, where the passages are offset to cause turbulent fluid flow between the layers. The passages 434 and 436 are offset in two directions, as illustrated by elements 438 and 440.

Figure 5:
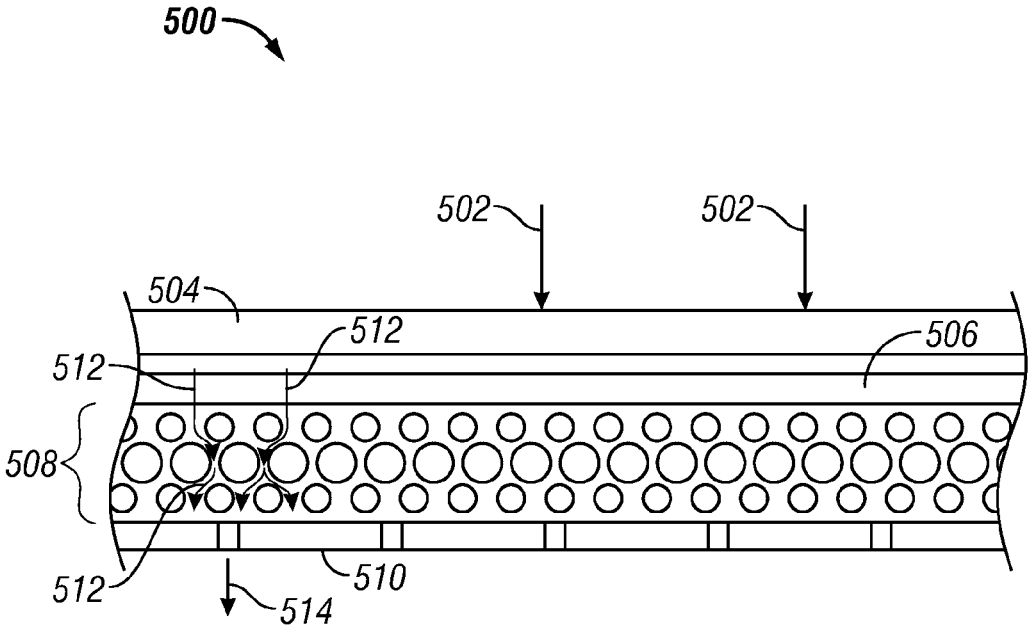
FIG. 5 shows a sectional side view of a portion of a flow control device made according to yet another embodiment the disclosure.

Referring now to FIG. 5, there is shown a sectional side view of a portion of a flow control device 500 made according to one embodiment the disclosure. The illustration shows the profile of sections of an upper half of a cylindrical flow control device 500 and tubular 510. The flow control device 500 is configured to enable and control radial flow of formation fluid 502 into the tubular 510 by creating a tortuous fluid flow path, thereby restricting fluid flow into the wellbore tubular. The flow control device 500 includes a shroud 504, screen 506 and tortuous flow path members 508. The tortuous flow path members 508 include beads or bead-like elements of selected sizes, wherein the spacing between beads and bead sizes are configured to cause a tortuous flow path 512 through the flow control device 500. The spacings between neighboring beads or other media would be configured to create a desired degree of orifice pressure drop, and the diameters or other surface dimensions of such beads or media would create flow pathways to include a desired frictional component to the total pressure drop across the device. The combination of pressure drop functions embodied in these and other embodiments may be selected in various proportions to create the desired flow for a fluid having a particularly expected viscosity, density, or another property. The fluid flows past the flow path members 508 and then into the tubular, as shown by arrow 514. The beads may be of any suitable geometry and composed of any suitable material such as a composites and/or metals. The flow path bead members 508 may function similarly to the layers discussed above in FIGS. 2 and 3, wherein the beads cause a pressure drop to achieve desired flow characteristics.

Figure 6:
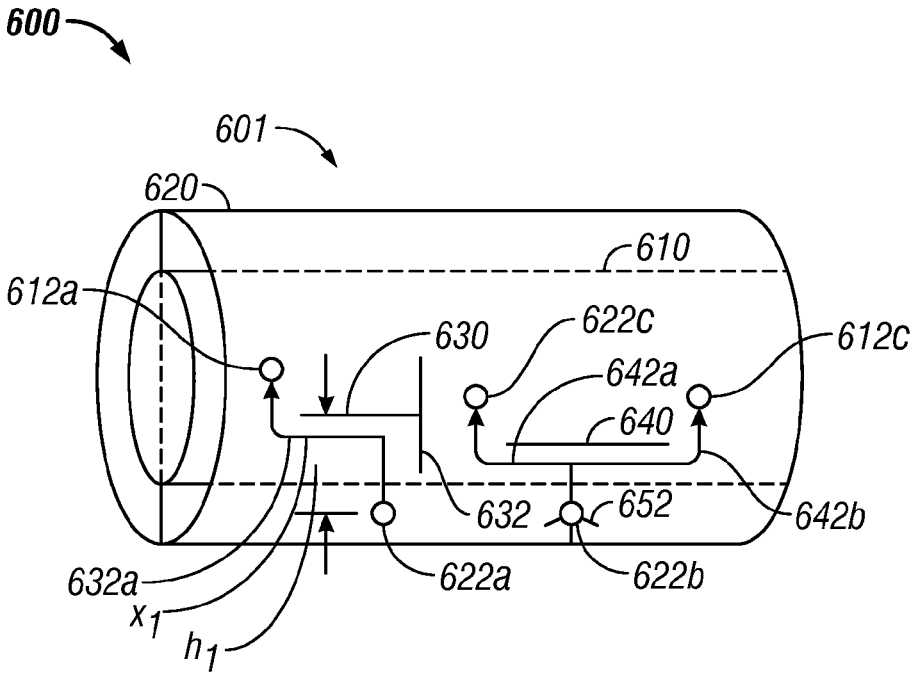
FIG. 6 shows a line diagram of a flow control device wherein obstructions create a selected tortuous fluid flow path between adjacent layers, according to one embodiment of the disclosure.

It should be noted that a device made according to disclosure may be configured to provide any type of tortuous flow path and/or to create any desired turbulence in such flow path. As an example, FIG. 6 shows a device 600 having an inner member 610 surrounded by an outer member 620. Member 620 receives the formation fluid 601 radially. The fluid 601 flows from an opening 622*a* to an opening 612*a* via a tortuous path 632*a*. A barrier 630 channels the fluid from the opening 622*a* to the opening 612*a* along the tortuous path 632*a*. Another barrier 632 may be provided to divert substantially all the fluid entering the opening 622*a* to opening 612*a*. The turbulence caused in the fluid along the path 632*a* is a function of the radial offset "h" and axial offset "x." The length of the flow 632*a* and the turbulence and tortuosity caused in such flow path may be altered by altering the radial offset and/or the axial offset. In another aspect, the flow from an opening 622*b* may be diverted to more than one opening in the member 610, such as openings 622*b* and 622*c*, by a barrier 640. The tortuous paths 642*a* and 642*b* and the turbulences created along such paths are a function of the radial and axial offsets. Other barriers may be placed in the spacing between the members 610 and 620 to create any desired tortuosity and turbulence in the fluid.

Figure 7:
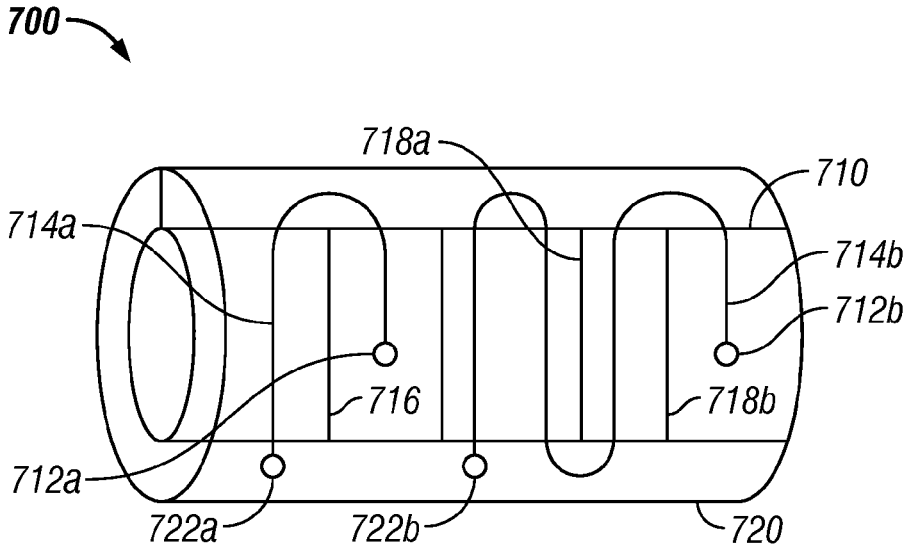
FIG. 7 shows a line diagram of a flow control device wherein obstructions create a selected tortuous fluid flow path between adjacent layers, according to another embodiment of the disclosure.

FIG. 7 shows a device 700 with two exemplary helical paths between an outer member 720 and an inner member 710. In one example, the fluid flows for an opening 722*a* in the outer member 720 to an opening 712*a* in the inner member 710 via a helical path 714*a*. The fluid flows along a channel 716 between the outer member 720 and the inner member 710. The helical path may be elongated by providing more helical loops around the inner member 710, such as shown by loop 714*b* between an opening 722*b* in member 720 to an opening 712*b* in member 710. The tortuous path 714*a* is created by channels 718*a* and 718*b*. Any other suitable configuration may be utilized to create desired tortuosity and turbulence in the fluid flow paths in the flow layers.

The disclosure herein is generally presented with respect to a producing or production well. It should be noted that the apparatus and methods described herein may also be utilized for any application having fluid flow between two or more flow regimes. For example, the apparatus and methods according to this disclosure may be utilized for injection wells, wherein a fluid, such a water or steam is injected from a wellbore into a formation or in wells generally referred to a "steam assisted gravity drainage" wells, wherein steam is injected into an upper zone that travels into a formation to alter viscosity of hydrocarbons in a production zone.

Thus, in one aspect, a passive flow control device is provided that in one configuration includes a longitudinal member configured to receive fluid radially along a selected length of the longitudinal member, the longitudinal member including flow restrictions configured to cause a pressure drop across the radial direction of the longitudinal member. In one configuration, the longitudinal member may include a plurality of layers, each layer including flow restrictions offset from flow restrictions in an adjoining layer. In another configuration, the longitudinal member may include layers of solid bead-like elements arranged to provide the pressure drop. In one configuration, adjoining layers may be formed with different sized bead-like elements.

In another aspect, the flow restrictions provide a tortuous path for the flow of the fluid therethrough configured to cause the pressure drop. In another aspect, the offset and radial distance between the layers may be configured to define at least in part the pressure drop. In one embodiment, the restrictions may be any suitable type, including, but not limited to openings or fluid passages in a metallic material, non-metallic material or a hybrid material. The openings may be stamped openings made as expanded metal slots or made in any other suitable form and method.

In yet another aspect, the flow control device may further include a sand screen for controlling flow of solid particles into the longitudinal member. In yet another aspect, the flow control device may include a shroud outside the longitudinal member or the sand screen to reduce the direct impact of the fluid flow onto the sand screen and/or the longitudinal member and to inhibit the flow of large solid particles to the sand screen and/or the longitudinal member. In yet another aspect, the longitudinal member may be integrated into the sand screen. The longitudinal member may include one or more members or sheets wrapped around each other or around a base pipe having flow passages for allowing the fluid to enter into the base pipe.

In yet another aspect, a method of completing a wellbore is provided, which method in one embodiment may include: providing a flow control device that includes a tubular with a first set of fluid flow passages and at least one member with a second set of fluid passages placed outside the tubular, wherein the first and second set of passages are offset along a longitudinal direction and the member is configured to receive a fluid along the radial direction, the radial direction being a direction at an angle to the longitudinal or axial direction of the member; placing the flow control device at a selected location in a wellbore; and allowing a fluid to flow between a formation and the flow control device. The method may further include selecting the offset to create a selected pressure drop in response to flow of the fluid having a selected characteristic or property. The characteristic or property may be density or viscosity of the fluid. In another aspect, the flow path through the flow control device includes a tortuous path that creates turbulences in the fluid based on the characteristics of the fluid. In one aspect, the flow path reduces a flow are when the fluid includes water or gas to create a higher pressure drop across the flow device, thereby reducing the flow of the fluid through the flow control device. In one aspect, the flow is reduced as the viscosity of the fluid decreases below 10 cP or the density of the fluid is above 8.33 lbs per gallon.

It should be understood that FIGS. 1-7 are intended to be merely illustrative of the teachings of the principles and methods described herein and which principles and methods may applied to design, construct and/or utilizes inflow control devices. Furthermore, foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. A passive flow control device for controlling flow of a fluid, comprising:

a longitudinal member configured to cause a selected pressure drop across the longitudinal member for fluid flowing radially along a selected length of the longitudinal member; and a screen disposed in the longitudinal member, the screen containing a plurality of solid bead-like elements having a size selected to cause the selected pressure drop in the radial direction across the longitudinal member.

2. The flow control device of claim 1, wherein the longitudinal member includes a plurality of layers, each layer including flow restrictions offset from flow restrictions in an adjoining layer.

3. The flow control device of claim 1, wherein the flow restrictions provide a tortuous path for the flow of the fluid therethrough configured to cause the selected pressure drop.

4. The flow control device of claim 2, wherein the offset and radial distance between the layers define at least in part the pressure drop.

5. The flow control device of claim 1, where in the longitudinal member includes layers of the solid bead-like elements arranged to provide the selected pressure drop.

6. The flow control device of claim 5, wherein the bead-like elements form layers, wherein adjoining layers including different sized elements.

7. The flow control device of claim 1, wherein the restrictions are one of: openings in a metallic, non-metallic material or a hybrid material; stamped openings; and expanded metal slots.

8. The flow control device of claim 1 further comprising a sand control device placed outside the longitudinal member for controlling flow of solid particles of selected sizes to the longitudinal member.

9. The flow control device of claim 1, wherein the longitudinal member is integrated into the sand control device.

10. The flow control, device of claim 1, wherein the longitudinal member includes a tubular member having fluid flow openings for receiving the fluid inside the tubular member and one or more layers outside the tubular member configured to receive the fluid along the radial direction and to provide a tortuous path to the received fluid.

11. The flow control device of claim 3, wherein the tortuous path is configured to provide turbulence in the fluid to cause the selected pressure drop to be substantial when the viscosity or density of the fluid corresponds to water or gas.

12. A flow control device, comprising:

a first member with a first set of fluid passages;

a second member with a second set of fluid passages placed outside the first member, wherein the first and second set of fluid passages are offset from one another and the second member is configured to receive a fluid along a radial direction; and a screen in the second member having with a plurality of solid bead-like elements disposed within the screen, the second member configured to cause a selected pressure drop across the second member, wherein the plurality of solid bead-like elements have a size selected to cause the selected pressure drop across the second member.

13. The apparatus of claim 12, wherein the offset is configured to create the selected pressure drop based on a characteristic of the fluid.

14. The apparatus of claim 13, wherein the characteristic of the fluid is one of viscosity or density.

15. The apparatus of claim 13, wherein the offset provides a tortuous path for the fluid and is configured to induce turbulence in the fluid based on a viscosity or density of the fluid.

16. The apparatus of claim 12, wherein the offset and spacing between the first and second members define at least in part a pressure drop across for a fluid flowing through the flow control device.

17. A method for making a fluid flow control device, comprising:

providing a tubular with a first set of fluid flow passages;

providing a member outside of the tubular, wherein the member includes a second set of fluid passages that are offset from the first set of fluid passages and are configured to receive formation fluid along a radial direction to a longitudinal axis of the tubular;

selecting a size for a plurality of bead-like elements to place in the member to provide a selected pressure drop across the member, the bead-like elements comprising a composite or a metallic material; and placing the plurality of solid bead-like elements within a screen located in the member.

18. The method of claim 17, wherein providing the member comprises selecting the offset to create a selected pressure drop in response to flow of formation fluid with a first characteristic.

19. The method of claim 18, wherein the first characteristic is one of viscosity or density.

20. The method of claim 17, wherein the tubular and member are configured to radially receive the formation fluid via substantially the entire length of the member.

21. The method of claim 17, wherein providing the member comprises providing a tortuous fluid flow path between the tubular and the member.

22. A method of completing a wellbore, comprising;

selecting a pressure drop for a flow control device to be placed at a selected location in the wellbore;

providing a flow control device that includes a tubular with a first set of fluid flow passages and at least one member with a second set of fluid passages placed outside the tubular, wherein the first and second set of passages are offset along a longitudinal direction and the member is configured to receive a fluid along the radial direction, the at least one member including a screen with a plurality of solid bead-like elements disposed within the screen, wherein selecting the pressure drop further comprises selecting at least one of: a spacing between the solid bead-like elements and a size of the solid bead-like elements;

placing the flow control device at the selected location in the wellbore; and allowing a fluid to flow between a formation and the flow control device.

23. The method of claim 22 further comprising selecting the offset to create a selected pressure drop in response to flow of the fluid having a selected characteristic that is one of density, viscosity, and Reynolds number.

24. A passive flow control device for controlling flow of a fluid, comprising:

a longitudinal member to configured to cause a selected pressure drop for fluid received generally radially into a production tubular along a selected length of the longitudinal member, the longitudinal member including layers with offset openings between the layers configured to cause a total pressure drop across the flow control device; and a screen disposed in the longitudinal member, the screen containing a plurality of solid bead-like elements having a size selected to cause the selected pressure drop in the radial direction across the longitudinal member, wherein the total pressure drop includes the selected pressure drop and wherein the total pressure drop is controlled at least in part by at least three of:

(a) a first pressure drop, determined at least in part by a distance of a planar offset;

(b) a second pressure drop, determined at least in part by a surface area between offset openings of layers;

(c) a third pressure drop, determined at least in part by a size of offset opening or the spacing between layers; and (d) a fourth pressure drop, determined at least in part by entry and exit profiles of openings and other flow restrictions within the flow control device.

* * * * *